US012558602B2

(12) United States Patent
Rossi

(10) Patent No.: US 12,558,602 B2
(45) Date of Patent: Feb. 24, 2026

(54) GOLF TRAINING DEVICE FOR OPTIMAL PUTTING SPEED FROM VARIOUS DISTANCES AND SLOPES

(71) Applicant: Matthew Rossi, Fairfield, CT (US)

(72) Inventor: Matthew Rossi, Fairfield, CT (US)

(73) Assignee: Matthew Rossi, Westport, CT (US)

( * ) Notice: Subject to any disclaimer, the term of this patent is extended or adjusted under 35 U.S.C. 154(b) by 995 days.

(21) Appl. No.: 17/714,807

(22) Filed: Apr. 6, 2022

(65) Prior Publication Data

US 2023/0364484 A1 Nov. 16, 2023

Related U.S. Application Data

(60) Provisional application No. 63/173,449, filed on Apr. 11, 2021.

(51) Int. Cl.
*A63B 69/36* (2006.01)
*A63B 57/30* (2015.01)

(52) U.S. Cl.
CPC ..... *A63B 69/3676* (2013.01); *A63B 57/357* (2015.10)

(58) Field of Classification Search
CPC ... A63B 69/3676; A63B 57/357; A63B 67/02; A63B 2071/0694
See application file for complete search history.

(56) References Cited

U.S. PATENT DOCUMENTS 3,885,796 A * 5/1975 King ..... A63B 69/3676 473/265
5,393,065 A * 2/1995 LeQuyea ..... A63B 69/36211 273/DIG. 30
2004/0152535 A1* 8/2004 Thompson ..... A63B 69/3676 473/258
2006/0189404 A1* 8/2006 Brayton ..... A63B 69/36211 473/261
2012/0295722 A1* 11/2012 Vancho ..... A63B 69/3691 473/409

* cited by examiner

*Primary Examiner* — Jeffrey S Vanderveen

(57) ABSTRACT

A golf putting device with guide rails, semi-circle placed into the real putting green cup and a round cup target with a flag that slides into varying positions of inches from behind the real cup ranging from 1 inch to 18 inches. A golf ball must have sufficient velocity to make it the target cup behind the real putting green cup in order for the ball to make it into the real cup. By attempting to putt past the actual putting green cup helps train the golfer to have consistent putting speed to overcome the fact the balls velocity slows down in its approach to the real cup where it's more likely to be affected by any defects on the putting surface. The ability of the device to slide behind the real cup, closer and or farther allows putting from various distances and speeds further training the golfer.

6 Claims, 7 Drawing Sheets

GOLF TRAINING DEVICE FOR OPTIMAL PUTTING SPEED FROM VARIOUS DISTANCES AND SLOPES

BACKGROUND OF THE INVENTION

The present invention relates generally to golf putting training device for optimal putting speed and more specifically it relates to a golf training device for optimal putting speed at various distances for training the golfer to putt consistently with the optimal putt speed from various distances, angles and slopes.

Regardless of skill level, putting accounts for approximately 43 percent of your total strokes, lower this percentage and your scores will go down. The USGA golf statistics as of Apr. 4, 2021 for Approach Putt Performance shows the average approach putt comes up 2 feet 4 inches short of the cup. The worst ranked approach putt performance of professional golfers comes up 3 feet 1 inches short of the cup hole.

"Speed is more important than target line when on a slope" (Dewhurst, 2015). One key to consistent putting is for the ball to approach the hole at the same speed every time no matter what distance the golfer is putting from. That way, you always know how much break to read since one variable, speed of the putt, is now a constant. The fastest speed a putt can have and still go in the hole is 4.3 feet per second (fps), rolling over the centerline of the hole. A putt can be going 2.1 fps at the edge of the cup (outside edge of the ball meets the inside edge of the hole) and fall in.

1. 51% of the average golfer's first putt opportunities take place from 11-30 feet. A distance golfer will face on about 9 greens each round.
2. From 11-30 feet, amateur golfer's 3-putt 7 times more frequently than the average PGA Tour player.
3. From beyond 30 feet, average golfers putt much more like PGA Tour players 3 putting as frequently due to lack of speed.

BRIEF SUMMARY OF THE INVENTION

The invention generally relates to a golf putting speed training device which includes a target cup/hole with a flag, guide rails and semi-circle anchor placed inside real putting green cup/hole. The target cup/hole has 2 equal loops on the sides that are inserted into the guiderails that slides into varying positions of inches from real cup/hole ranging from 1 inch to 18 inches.

DETAILED DESCRIPTION OF THE INVENTION

Figure 1:
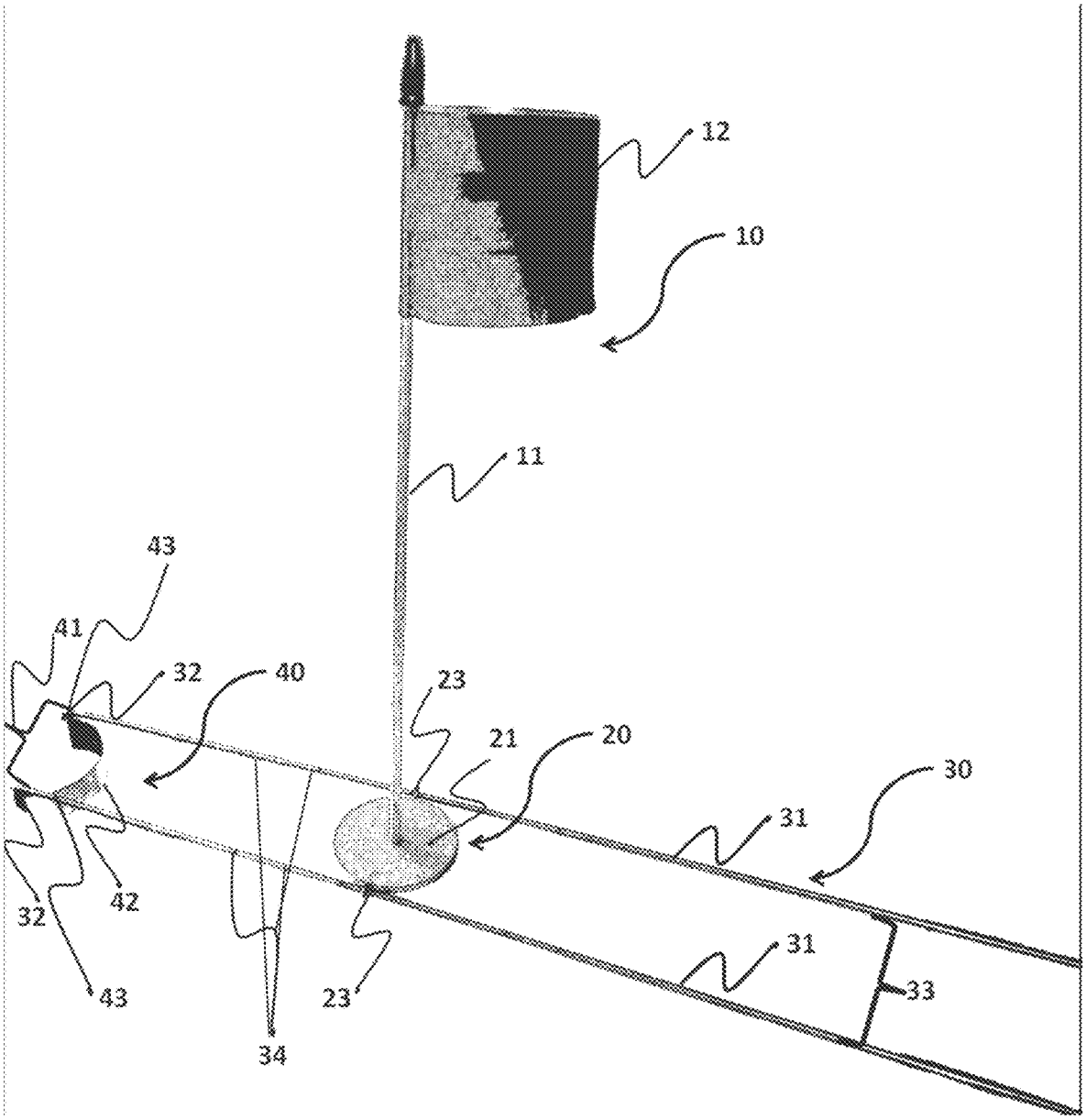
FIG. 1 is a perspective of the putting practice speed device according to the invention.
Figure 2:
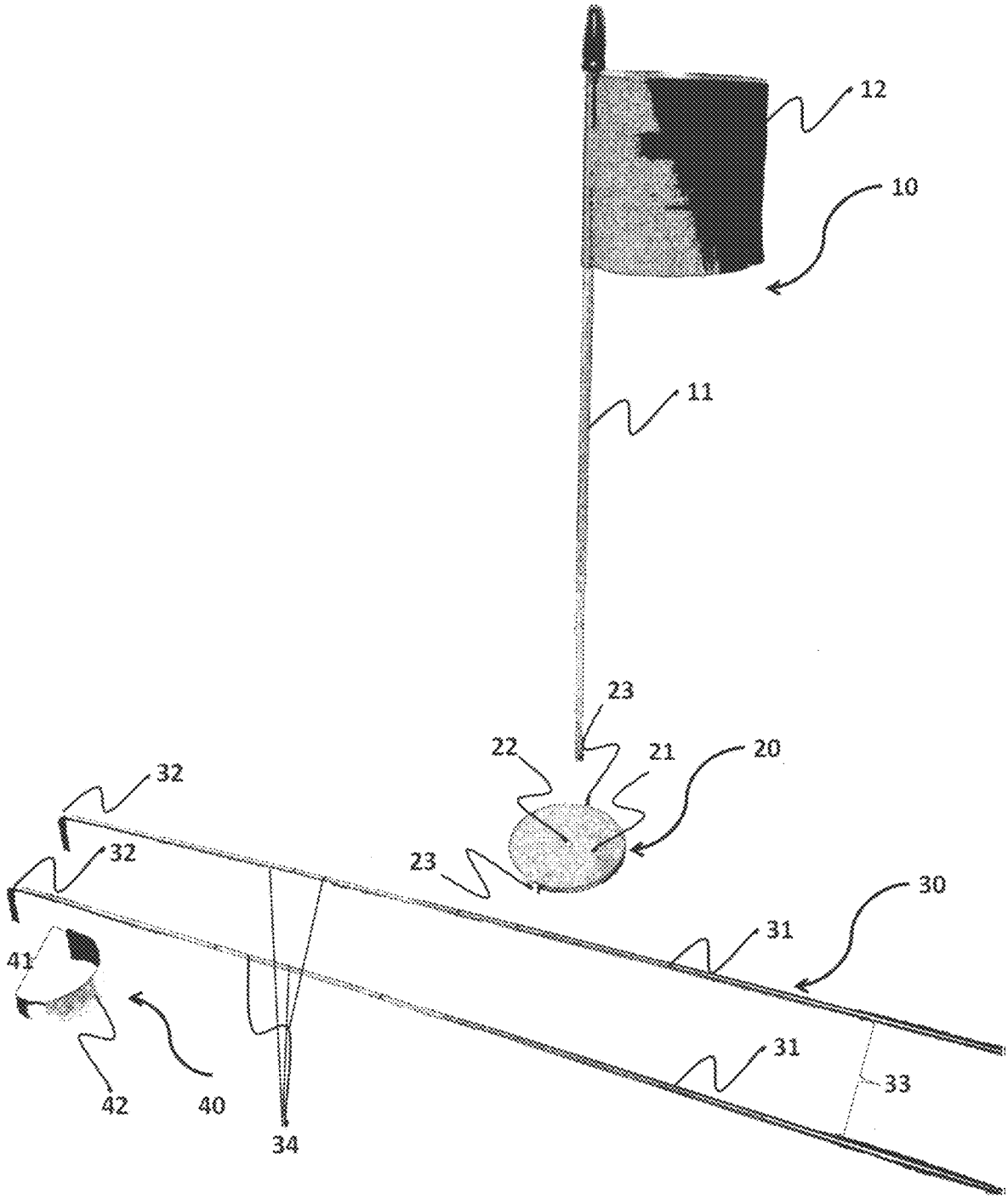
FIG. 2 is sectional view of the putting practice speed device according to the invention.

Turning now descriptively to the drawings, in which similar reference characters denote similar elements throughout the several views, the figures illustrate Golf Device with a Flag, guide rails and semi-circle anchor to putting green cup and a hole target that slides into varying positions of inches from cup ranging from 1 inch to 18 inches.

Flag. The flag is a target as on any putting practice green anchored to the sliding hole target. The Flag (10) is made up of a round pole measuring approximately 24 inches (11) and a flag attached to the upper part of the round pole (12) and connected to the center of the Hole Target (22). The Flag (10) is removable from the Hole Target (20) at a center hole to hold the flag (22) of the Hole Target (20) for ease of storage and travel. Various heights of the Flag Pole (11) can range from 20 Inches to and through 30 Inches.

Hole Target. The round cup/hole target is the size of a putting green practice hole of 4.25 inches sliding on the Guide Rails, 1 inch from the actual putting green cup hole to 18 inches from actual putting green cup. The cup/hole target slides on the guide rails by 2 equal loops attached to the target cup/hole. The circular Hole Target (20) is positioned on the Guide Rails (30) at varying distance from the actual Putting Green Cup to the Hole Target (24). Distances vary from 1 inch up to approximately 18 inches past the actual Putting Green Cup. The circular Hole Target (20) is a Circle measuring approximately 4 inches in diameter (21) and has 2 circle guides attached equally to each side of the round Hole Target directly across from the other at approximately ⅛ inch our from the side of the round Hole Target which sit around the Guide Rails (23). The Hole Target (20) has a center hole to hold the flag (22) which allows the Flag (10) to be inserted into it. The Hole Target (20) can vary in size from 4 inches to and through 4.25 inches.

Guide Rails. The Guide Rails are attached to a semi-circle anchor and hold the Hole Target allowing for movement from 1 inch to 18 inches from the actual putting green. The Guide Rails allow the Hole Target to slide back and forth to varying distances from actual putting green cup to the hole target. The 2 Guide Rails measuring approximately 24 inches in length (31) with a right angle at one end of each guide attaching to a semi-circle anchor (32) and connected to the Semi Circle Anchor (40). The Guide Rails approximately 4.25 inches apart (33) and each Guide Rail has Guide Marks from 1 inch to 18 inches (34) from the Semi Circle Anchor (40). Varying lengths of Guide Rails (30) are approximately 24 inches in length to accommodate longer practice putts.

Semi Circle Anchor. The Semi Circle sits in the actual putting green cup and measures the radius of the actual putting green cup of 4.25 inches. The Semi Circle Anchor rotates within the cup and allows for ease of rotation of the Golf Device to any angle. It is attached to the Guide Rails. The Semi Circle Anchor (40) is connected to the Guide Rails (30) at a right angle at the end of each guide attaching to the semi-circle anchor (32). The Semi-Circle measuring approximately 4.25 Inches in radius (41) with a depth of Semi Circle measuring approximately 1½ inches in depth sitting in the putting green cup (42). The Semi Circle Anchor (40) sits inside the Actual Putting Green cup (60) and can rotate 360 degrees in a circular motion left (FIG. 10.1) or right (FIG. 10.2) to adjust to varying Putting Green practice desires. Varying depths (42) of the Semi Circle Anchor (40) from approximately 1 inch to 2 inches is possible.

Golfer. Golfer addressing the putt toward the Golf Device. The Golfer (50) addresses the putt in line with the Golf Device.

Actual Putting Green Cup. Actual Putting Green Cup. The actual Putting Green cup (60) diameter is not to exceed 4.25 inches across every golf hole on every course as according to USGA rules.

INDEX OF ELEMENTS

10: Flag
11: Round Pole Measuring Approximately 24 Inches
12: Flag Attached To The Upper Part of The Round Pole
20: Hole Target
21: A Circle Measuring Approximately 4 Inches in Diameter
22: A Center Hole To Hold The Flag
23: 2 Circle Guides Attached Equally To Each Side of The Round Hole Target Directly Across From The Other at Approximately ⅛ Inch Our From The Side of The Round Hole Target Which Sit Around The Guide Rails
24: Varying Distance From The Actual Putting Green Cup To The Hole Target
30: The Guide Rails
31: 2 Guide Rails Measuring Approximately 26 Inches in Length
32: A Right Angle at One End of Each Guide Attaching To A Semi Circle Anchor
33: Guide Rails Approximately 4.25 Inches Apart
34: Guide Marks From 1 Inch To 18 Inches
40: Semi Circle Anchor
41: Semi Circle Measuring Approximately 4.25 Inches in Radius
42: Semi Circle Measuring Approximately 1½ Inches in Depth Sitting in The Putting Green Cup
43: Attached To The Guide Rails
50: Golfer
60: Actual Putting Green Cup Connections of Main Elements and Sub-Elements of Invention In drawing FIG. 1, the Flag (10) is connected to the Hole Target (20) at the center (22) and the Circular Guides (23) are connected to the Hole Target (20) on each side equally approximately ⅛ inch from the edge of the Hole Target (20) and the Guide Rails (30) are connected to the Circular Guides (23) and the Circular Guides (23) slide back and forth on the Guide Rails (30) from 1 inch (24) to 18 inches (24) from the Semi Circle Anchor (40) and the right angle ends (32) of each Guide Rail (30) are connected (43) to the Semi Circle Anchor (40).

Operation of Preferred Embodiment

Figure 3:
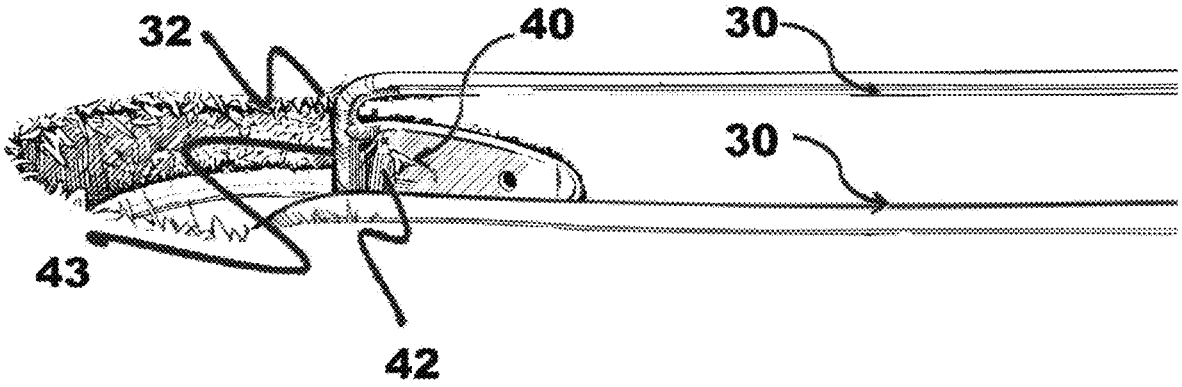
FIG. 3 is a side view of the guiderails and semicircle anchor in the real cup/hole according to the invention.
Figure 5:
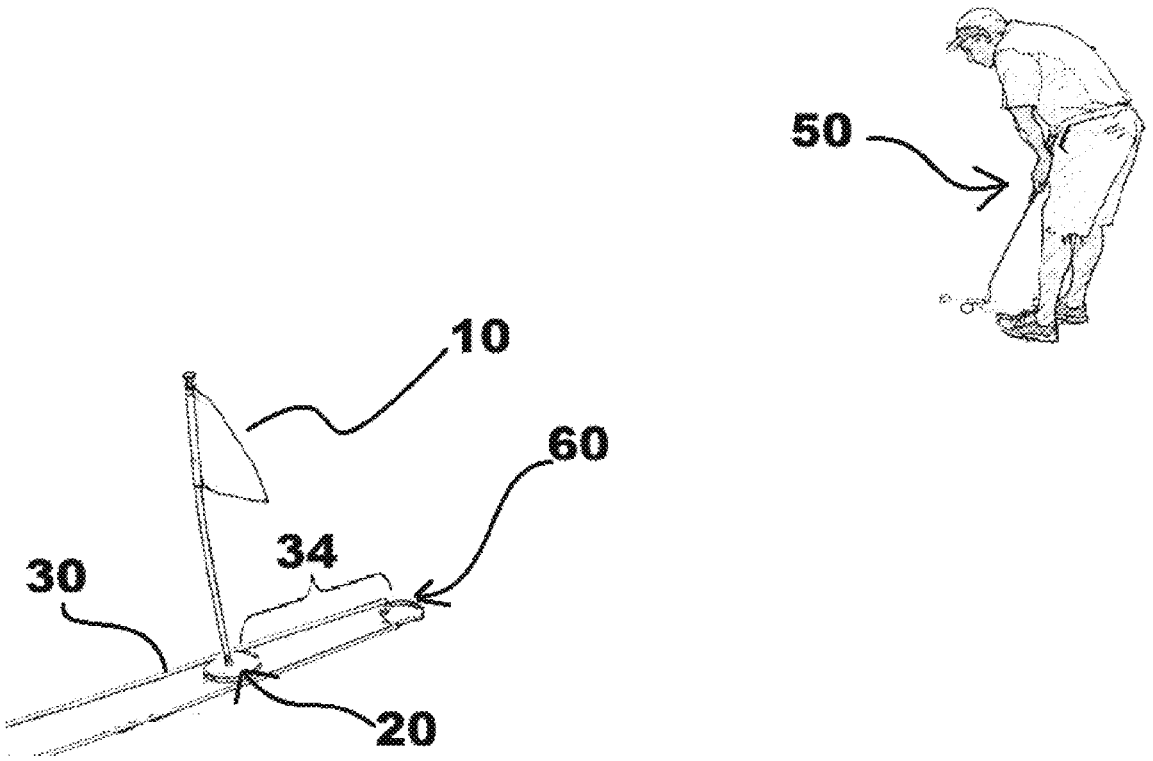
FIG. 5 is side top view of the golfer putting to the putting practice speed device according to the invention.
Figure 6:
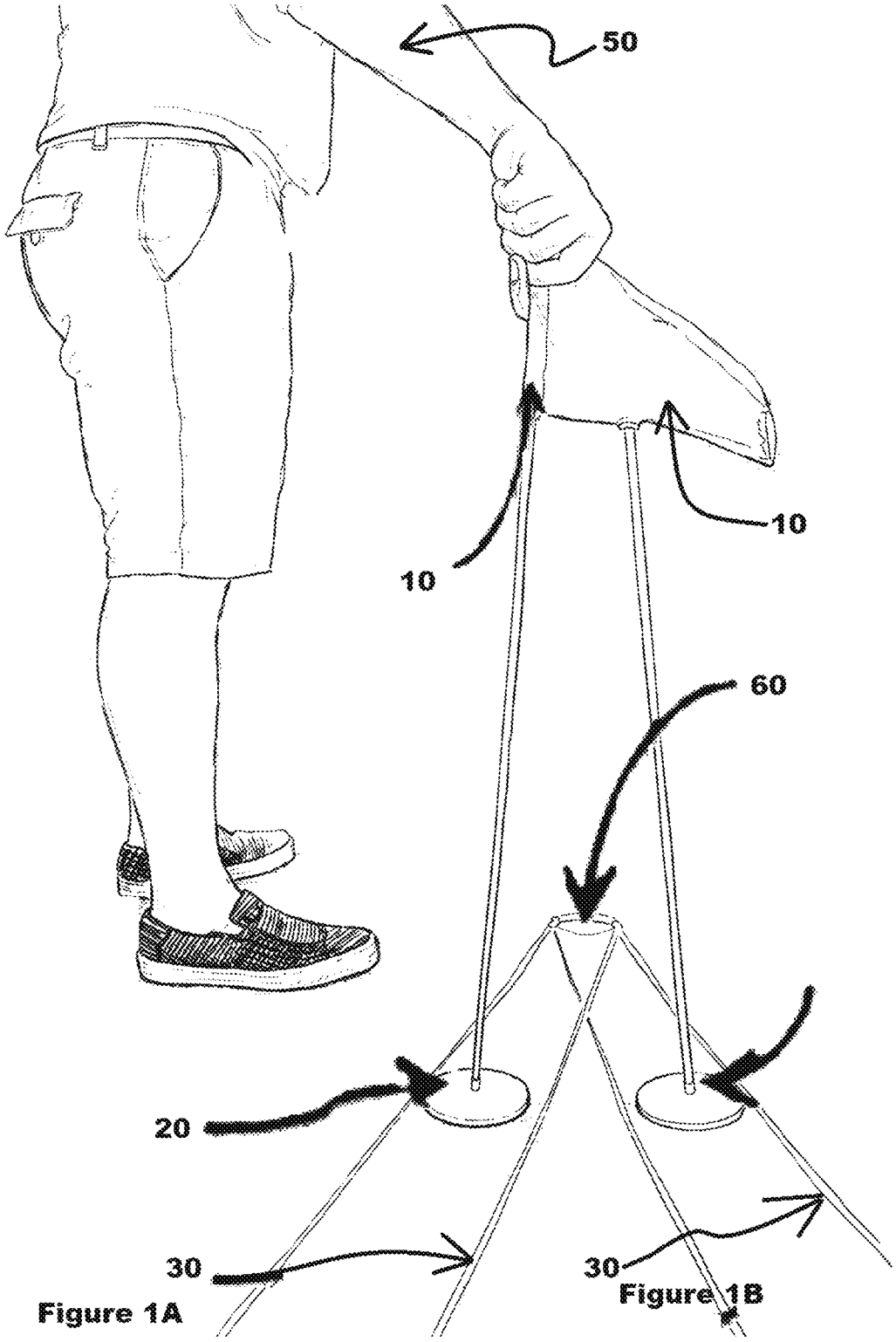
FIG. 6 is top rear view of the golfer rotating the putting practice speed device 360 degrees in a circular direction according to the invention.

The Golfer (50) places the Golf Device into the putting green cup at the Semi Circle measuring approximately 1½ inches in depth in the putting green cup (42) as shown in drawing FIG. 3. In drawing FIG. 6 the Golfer (50) can the rotate the Golf Device in a 360 degree motion left (FIG. 1A) and or right (FIG. 1 B) to align the Golf Device in the direction of desired putting taking into consideration green slope angles. In drawing FIG. 6, the Golfer (50) can then adjust the Hole Target (20) on the Guide Rails (30) at varying distances from the actual putting green cup to the hole target (24) by using the guide marks from 1 inch to 18 inches (34). In drawing FIG. 5, the Golfer (50) addresses the ball putting toward the Hole Target (20) and putts with enough speed to reach the Hole Target (20) which has the Flag (10) attached to it. By attempting to putt past the actual putting green cup trains the Golfer (50) to have consistent putting speed to overcome the fact that as your ball slows down in its approach to the hole it is more likely to be affected by any defects on the putting surface. The faster your ball is traveling the less chance there will be of a spike mark or an undetected pitch mark knocking it off course. For a putt to be holed, it has to have enough time for the ball, 1.68 inches in diameter to fall half that distance, or 0.84 inches, or more. Gravity is a constant force (9.8 m/s 2) and 0.84 inches is approximately 0.021336 meters. Given that distance (d)=0.5 at 2 and solving for time:

$$0.021336\ \text{m}=0.5*9.8\ \text{m/s2}*t2.$$

$$0.021336\ \text{m}=4.9\ \text{m/s2}*t2.$$

$$0.021336\ \text{m}/4.9\ \text{m/s2}=t2.$$

$$0.004354\ \text{s}\ 2=t2.$$

$$T=0.065987\ \text{seconds}.$$

Figure 4:
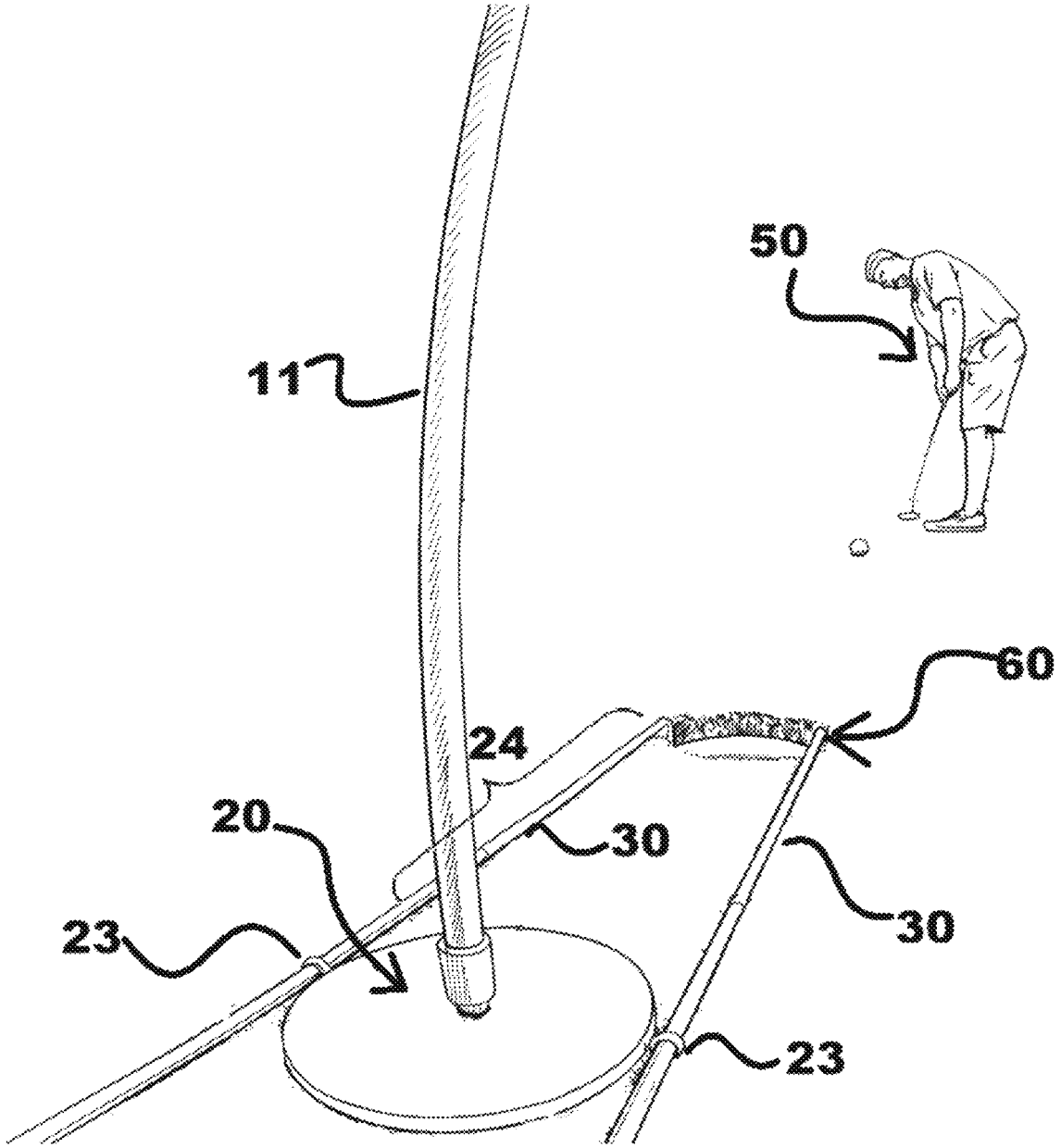
FIG. 4 is rear view of the golfer putting practice speed device according to the invention.
Figure 7:
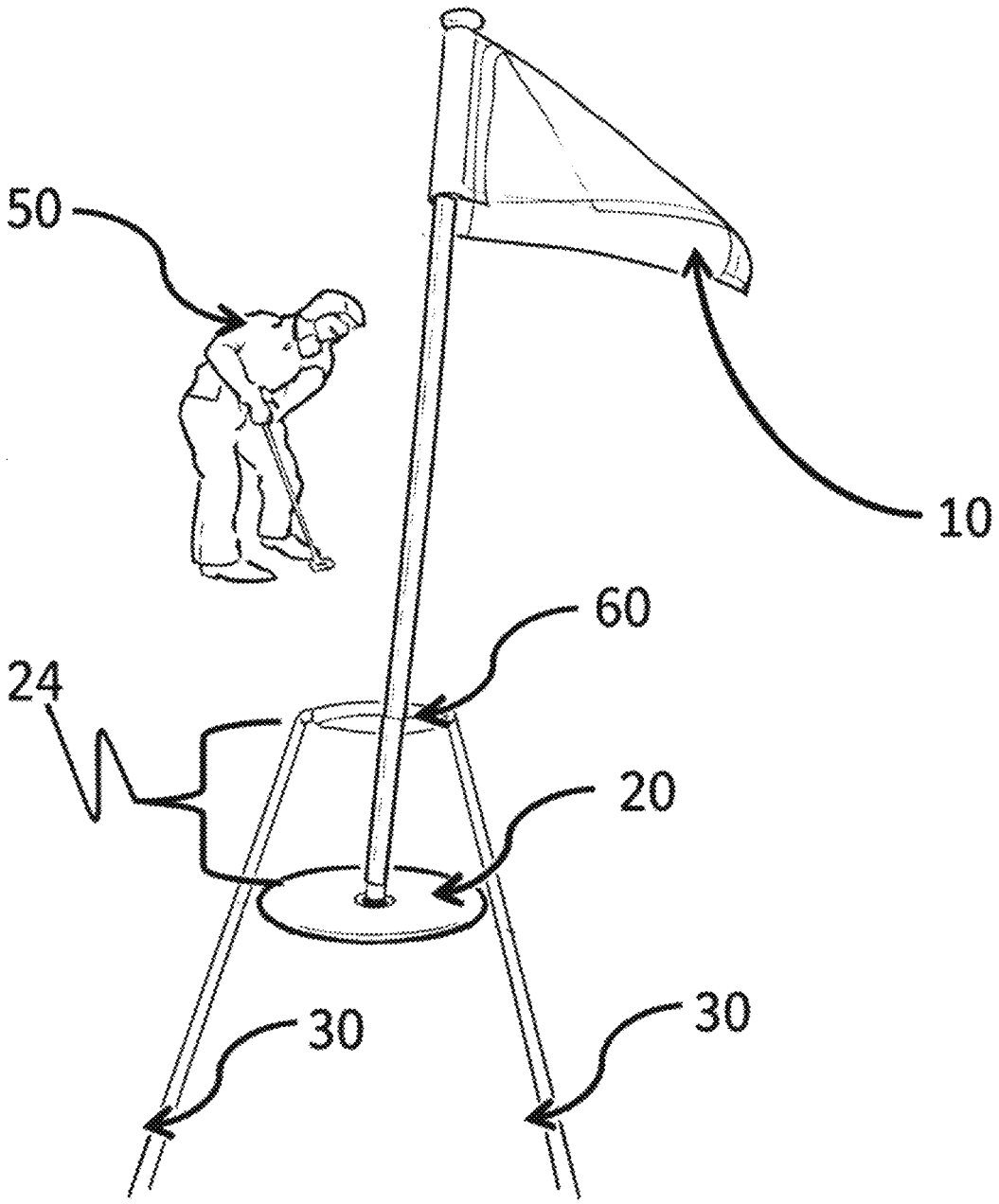
FIG. 7 is a rear view of the putting practice speed device according to the invention.

Based on the math, a golf ball needs approximately 0.066 seconds to fall 0.84 inches, striking some part of the back of the cup at the equator for the ball to be holed. The Golfer (50) practicing consistent attempted putts past the actual putting green cup to the Hole Target (20) as in drawing FIG. 4, drawing FIG. 5 and drawing FIG. 7 will have a greater chance of holing a putt.

2021 Year to date USGA golf statistics as of Apr. 4, 2021 for Approach Putt Performance shows the average approach putt comes up 2 feet 4 inches short of the cup. The worst ranked approach putt performance of professional golfers comes up 3 feet 1 inches short of the cup hole.

The invention claimed is:

1. A golf putting practice device for optimal ball speed from various distances comprising:

a target cup/hole that's 4.0 inches in diameter with 2 equal loops directly on either side of the target cup/hole with a flag in the middle of the target cup/hole;

the target cup/hole is adjustable and slides along guiderails behind the real putting green cup/hole and can slide 1 inch to 18 inches past the real cup/hole on two 24 inch long guide rails with inch markings on the guiderails;

the guiderails attached to a semi-circle anchor which is 4.25 inches in radius and is 1.5 inches in depth sitting inside the real putting green cup/hole;

the semi-circle anchor is deep enough to provide 1.5 inches into the real cup/hole to allow a putt with enough speed to reach the target cup/hole behind the real cup/hole to have a golf ball fall into the real cup/hole without any effects from the device.

2. The golf putting speed practice device recited in claim 1 wherein said object is to provide an intuitive visualization of a target cup/hole past the actual putting green cup/hole desired hole to the golfer so the correct putt speed is attained from any distance by having the target/cup slide 1 inch to 18 inches behind the real cup/hole.

3. The golf putting speed practice device recited in claim 1 wherein said device can be rotated by 360 degree circle on the putting green inside the real cup/hole for training the golfer to putt consistently with the optimal putt speed from various distances, angles and slopes.

4. The golf putting speed practice device recited in claim 1 wherein said device positively reinforces golfer to visualize the putting line with device guiderails.

5. The golf putting speed practice device recited in claim 1 wherein said device has guiderails with inch markings for target cup/hole to be adjusted 1 inch to 18 inches behind the real cup/hole.

6. The golf putting speed practice device recited in claim 1 wherein said device has a flag in the target cup/hole behind the real cup/hole further reinforcing target for optimal speed.

* * * * *